US010682584B1

(12) United States Patent
Milbauer

(10) Patent No.: US 10,682,584 B1
(45) Date of Patent: Jun. 16, 2020

(54) INTERACTIVE ACTIVITY GAME

(71) Applicant: Marsha Milbauer, Coconut Creek, FL (US)

(72) Inventor: Marsha Milbauer, Coconut Creek, FL (US)

( * ) Notice: Subject to any disclaimer, the term of this patent is extended or adjusted under 35 U.S.C. 154(b) by 0 days.

(21) Appl. No.: 16/527,172

(22) Filed: Jul. 31, 2019

(51) Int. Cl.

| | |
|---|---|
| ***A63F 9/00*** | (2006.01) |
| ***A63H 33/38*** | (2006.01) |
| ***A63F 11/00*** | (2006.01) |
| ***B42D 1/00*** | (2006.01) |
| *A63F 9/06* | (2006.01) |

(52) U.S. Cl.
CPC ..... *A63H 33/38* (2013.01); *A63F 11/0011* (2013.01); *B42D 1/006* (2013.01); *A63F 9/00* (2013.01); *A63F 2009/0036* (2013.01); *A63F 2009/0661* (2013.01); *A63F 2009/0662* (2013.01); *A63F 2011/002* (2013.01); *A63F 2011/0016* (2013.01)

(58) Field of Classification Search
CPC ..... A63F 2011/002; A63F 2011/0016; A63F 2011/0018; A63F 9/1011; A63F 9/00; A63F 2009/0036; A63F 2009/0039; A63F 2009/0661; A63F 2009/0662
USPC ..... 273/276, 429, 142 R, 142 A–142 D, 273/142 H, 142 HA, 142 J, 273/142 JA–142 JD, 142 K
See application file for complete search history.

(56) References Cited

U.S. PATENT DOCUMENTS 2,018,038 A * 10/1935 Steinberg ..... A63F 5/043 273/141 R
2,193,048 A * 3/1940 Vander Velde ..... G09B 17/00 434/170
2,322,564 A * 6/1943 Buckley ..... A63F 3/0423 273/141 R
2,466,981 A * 4/1949 Daigle ..... A63F 5/04 273/141 R
3,542,368 A * 11/1970 Ashley ..... A63F 3/06 273/276
3,817,531 A * 6/1974 King ..... A63F 3/00006 273/243
3,876,207 A * 4/1975 Jones ..... A63F 3/00694 273/239
3,895,805 A * 7/1975 Enos ..... A63F 9/00 273/236

(Continued)

*Primary Examiner* — Benjamin Layno
(74) *Attorney, Agent, or Firm* — Sanchelima & Associates, P.A.; Christian Sanchelima; Jesus Sanchelima

(57) ABSTRACT

An activity game that results in skill developing activities resulting in humorous pictures is disclosed. The activity game includes a plurality of picture pages, a spinning wheel, at least one pointer, a sketch pad and at least one sketching tool. Each side of the picture page has a unique page identity and distinct pictures. The spinning wheel is operated to achieve a rotating configuration. The spinning wheel is divided into a plurality of sectors. Each sector includes one unique page identity. The pointer connects with the spinning wheel and points to a sector from the plurality of sectors and the unique identity of the sector during a stationary configuration of the spinning wheel. In operation, the spinning wheel is rotated and when it is stationary, the player reads the unique identity pointed by pointer on the spinning wheel and searches for the unique identity to sketch a picture depicted.

10 Claims, 8 Drawing Sheets

(56) References Cited

U.S. PATENT DOCUMENTS

| | | | | | |
|---|---|---|---|---|---|
| 4,326,711 | A | * | 4/1982 | Giallombardo | A63F 5/04 273/142 HA |
| 4,588,210 | A | | 5/1986 | Tabatch et al. | |
| 4,979,324 | A | * | 12/1990 | Rehtmeyer | A63F 3/00006 273/254 |
| 5,288,084 | A | * | 2/1994 | Miller | A63F 9/00 273/440 |
| 5,827,103 | A | | 10/1998 | Carter | |
| 7,828,293 | B1 | * | 11/2010 | Pruzan | A63F 3/00 273/139 |

* cited by examiner

INTERACTIVE ACTIVITY GAME

II. BACKGROUND OF THE INVENTION

1. Field of the Invention

The present disclosure relates to an activity game for children and adults. More particularly, the present disclosure relates to an interactive activity game for skill development and entertainment.

2. Description of the Related Art

Interactive activity games are generally played for entertainment, learning and engaging oneself to spend a quality time. Hence, there is a need for an interactive activity game for children and adults.

Several designs for various interactive activity games have been designed in the past. None of them, however, includes an interactive activity game that includes a number of skill developing activities that result in a humorous picture and played by any number of children and adults. None include a drawing game having a spinner and a series of images representing different sets of faces and facial features, where the player spins the spinner and the number corresponds to one of a multiple of drawing selections.

Applicant believes that a related reference corresponds to a U.S. Pat. No. 5,827,103 filed by Sharon Carter for a Dollhouse activity book. The Sharon reference discloses a dollhouse activity book with several pages depicts rooms in a house and provided with movable and attachable objects like dog and doll inserts. However, playing with dollhouse activity book may not provide skill developing activities and each time a humorous outcome of play.

Another related application is U.S. Pat. No. 4,588,210 by Peer Group Communications Corp. for a folding game book. The patent application '210 discloses an improved folding game book in which each sheet may be removed from the others and where each sheet, when removed, contains a complete package of information. However, playing with folding game book may not provide the combination of skill developing activities and each time a humorous outcome of play.

Other documents describing the closest subject matter provide for a number of more or less complicated features that fail to solve the problem in an efficient and economical way. None of these patents suggest the novel features of the present invention.

III. SUMMARY OF THE INVENTION

It is an object of the present invention to provide an interactive activity game that enhances a number of skill developing activities and which results in the formation of humorous pictures.

It is an object of the present invention to provide an activity game that can be played by adults and children.

It is yet another object of the present invention to provide an activity game that engages players to spend time relaxing and relieve stress.

It is still another object of the present invention to provide an activity game that includes a book having picture pages containing humorous distinct pictures and played by spinning a spinning wheel that refers to picture pages from which distinct pictures are selected and sketched till a humorous picture is formed.

It is yet another object of the present invention to provide an activity game that while playing improves eye-hand coordination.

Further objects of the invention will be brought out in the following part of the specification, wherein detailed description is for the purpose of fully disclosing the invention without placing any limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents a perspective view of various components of an activity game 10 having a book 20 with a number of picture pages 21, a spinning wheel 30, a sketch pad 40 and a sketching tool 50, in accordance with one embodiment of the present disclosure. The book 10 is covered by a front cover 22;

FIG. 2 represents a perspective view of book 20 illustrating back cover 23;

FIG. 3 represents a perspective view of book 20 in an open configuration illustrating unique page identity 24 and distinct pictures 25, in accordance with one embodiment;

Figure 1:
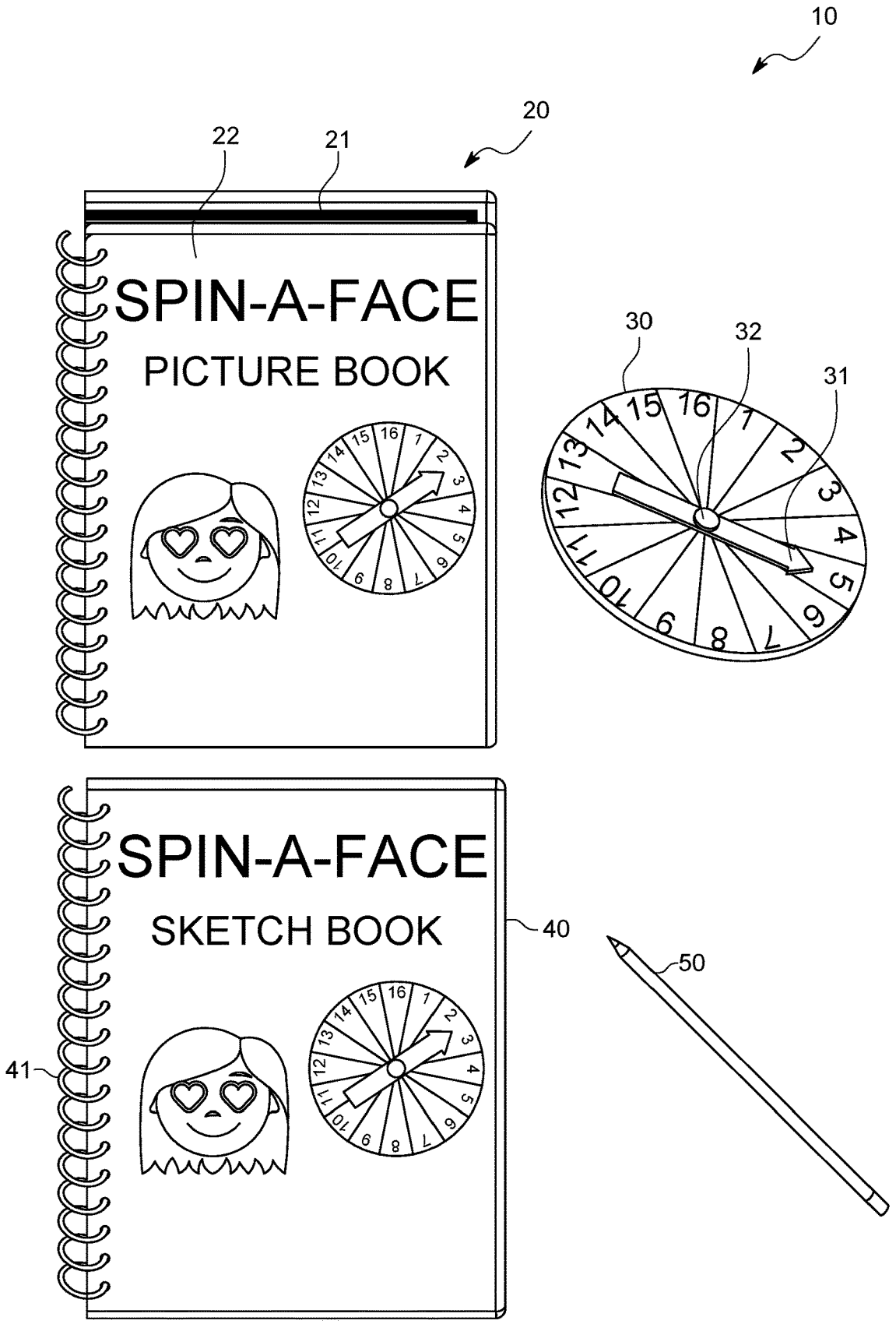
Figure 2:
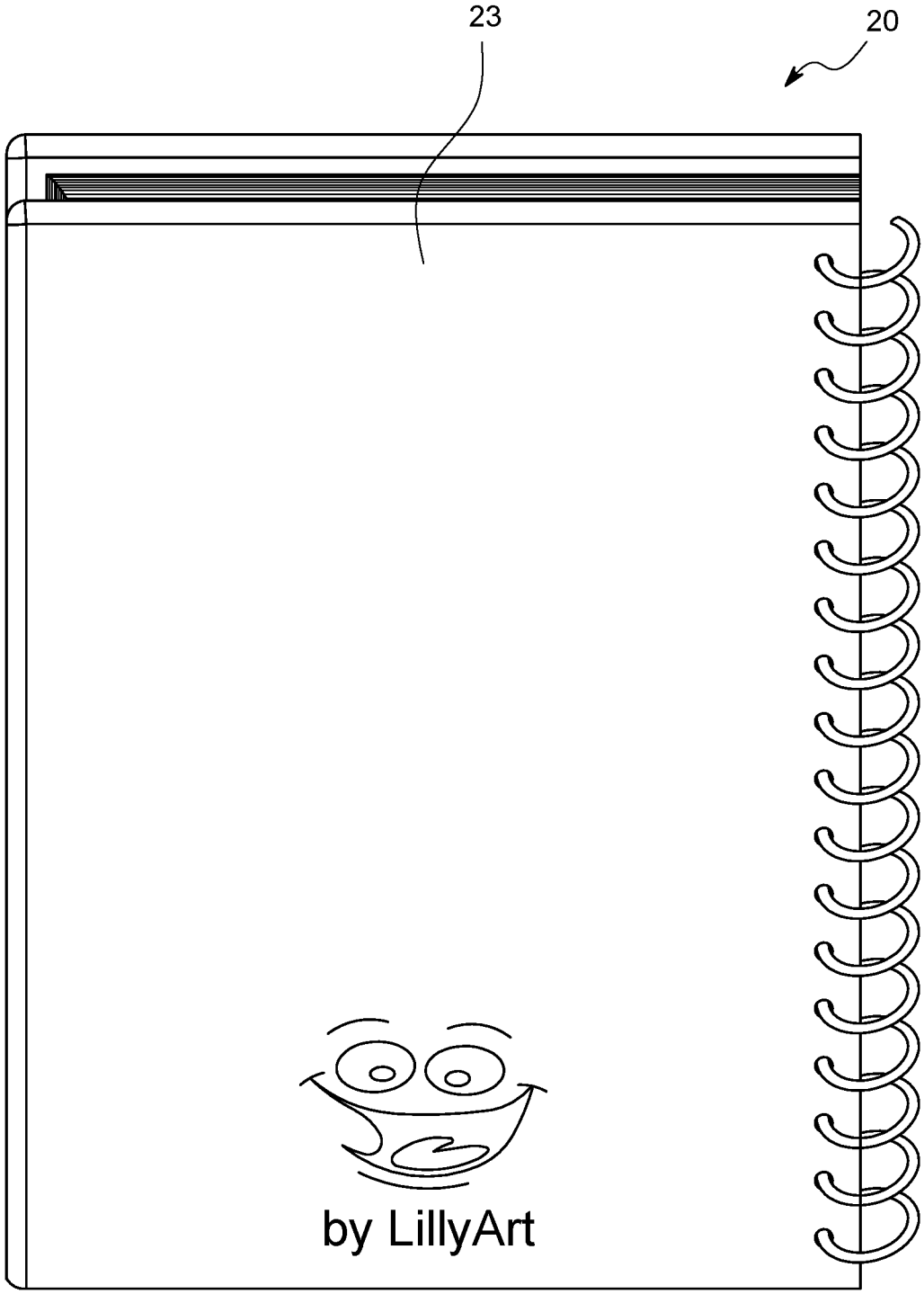
Figure 3:
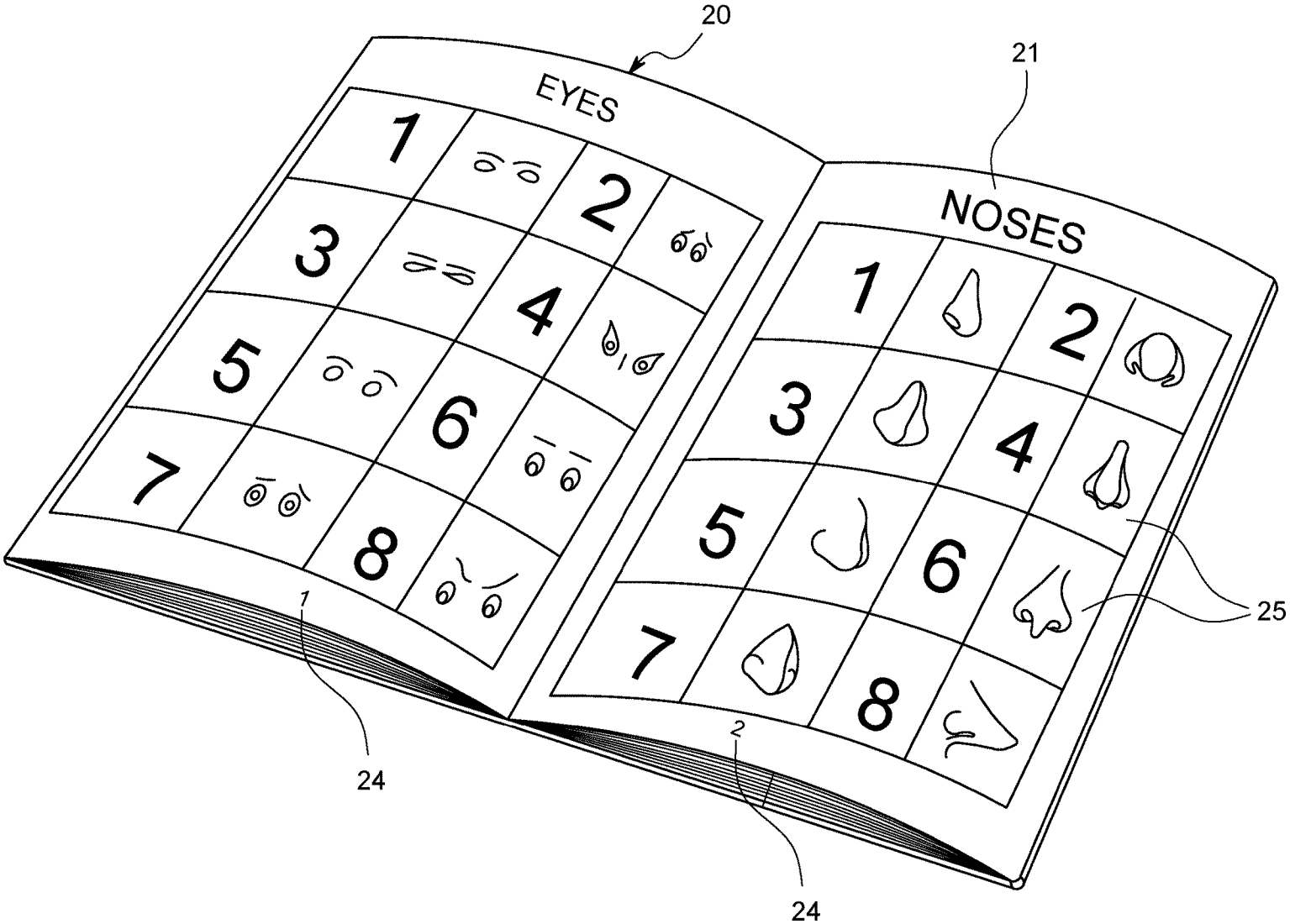
Figure 4:
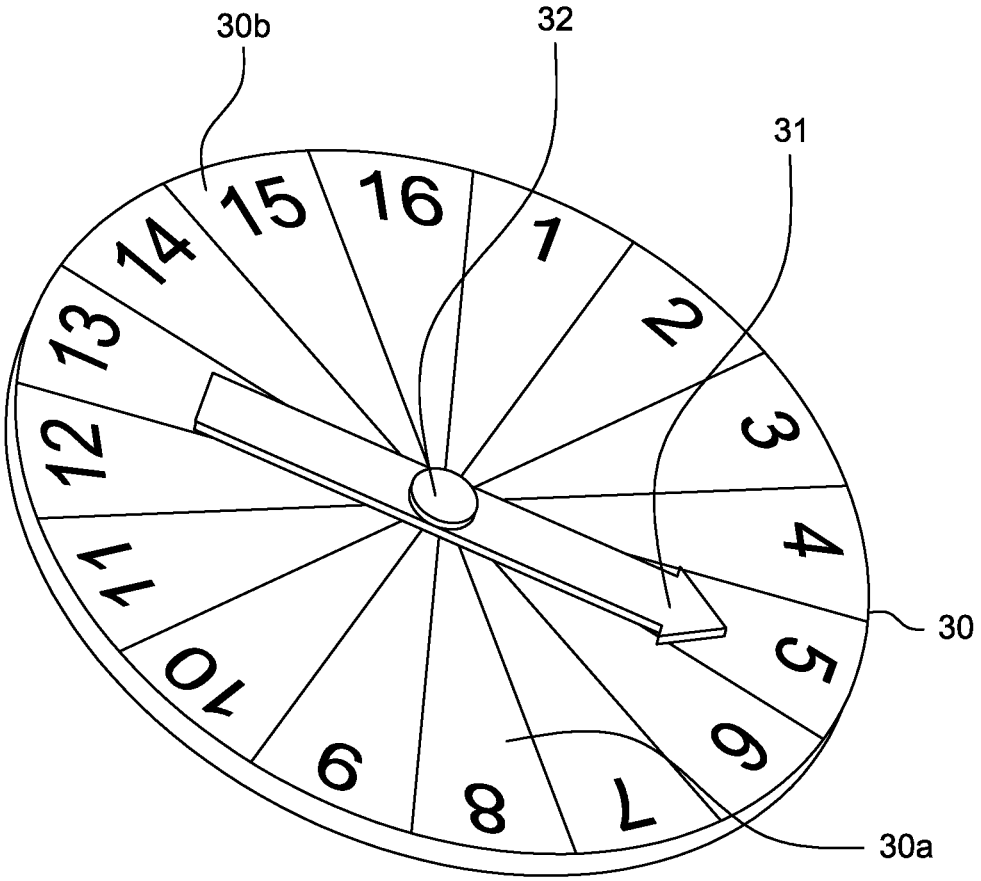
FIG. 4 represents a perspective view of a spinning wheel 30 with a pointer 31, in accordance with an embodiment of the present disclosure.
Figure 5:
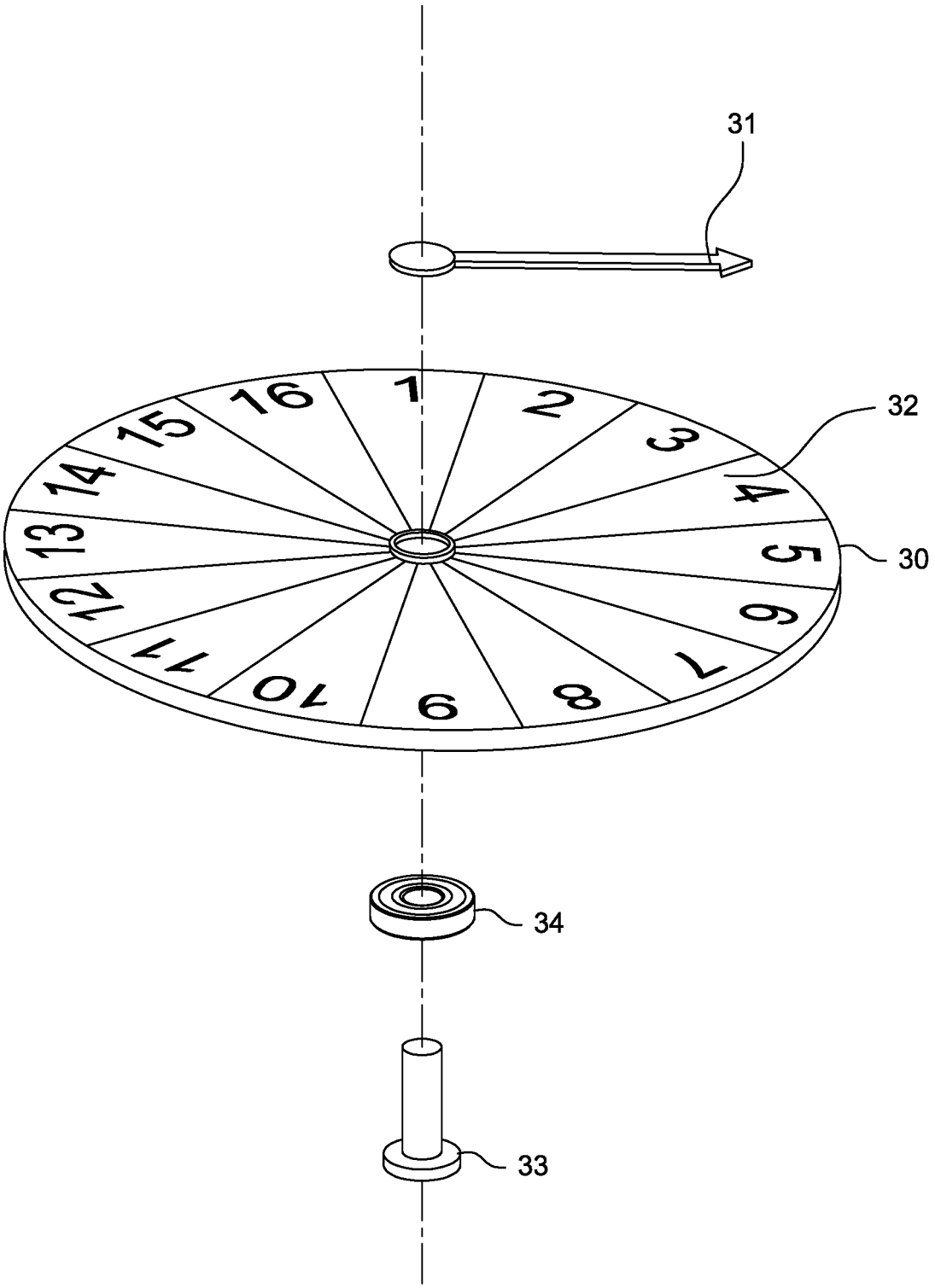
FIG. 5 represents an exploded view of spinning wheel 30.
Figure 6:
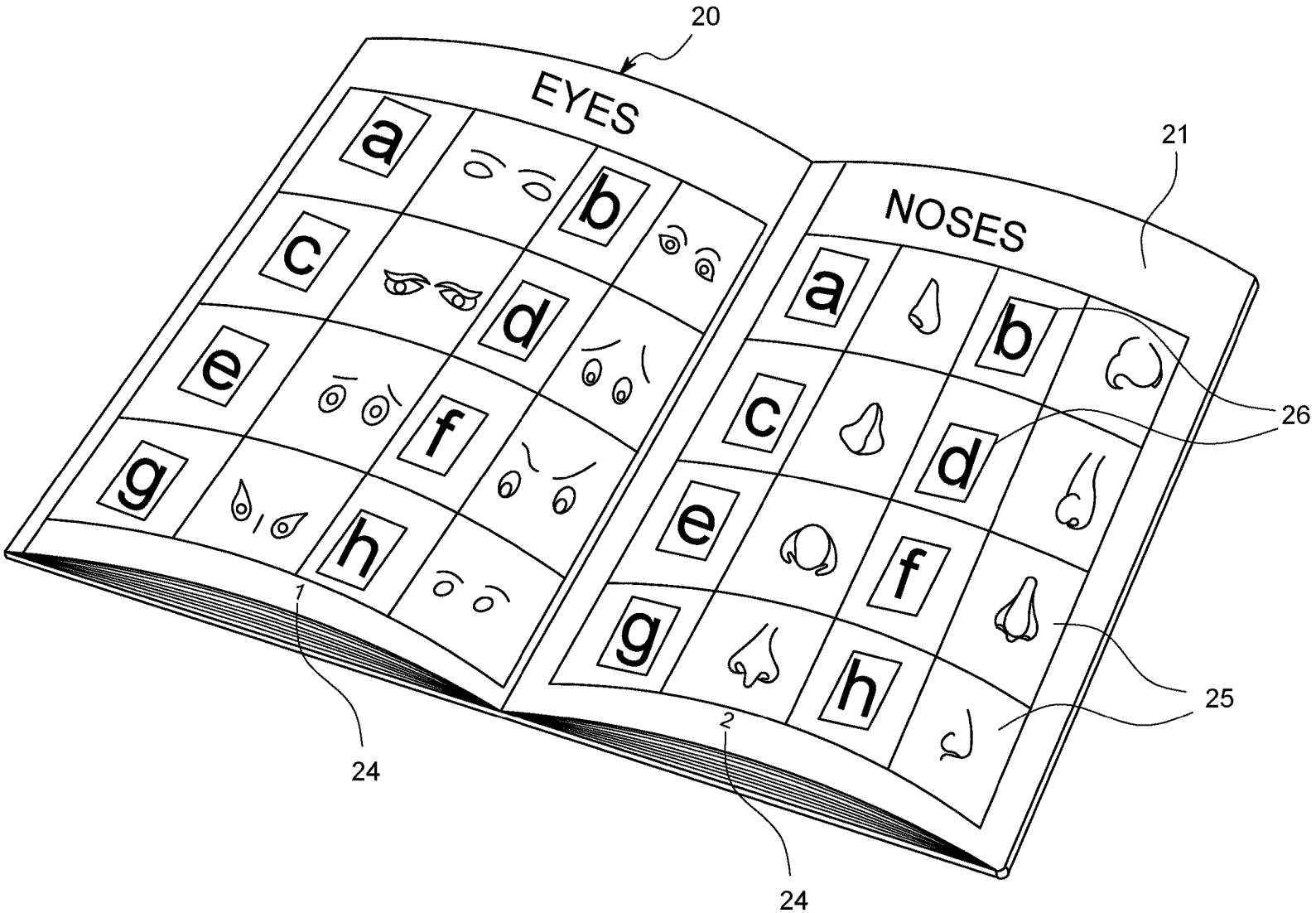
Figure 7:
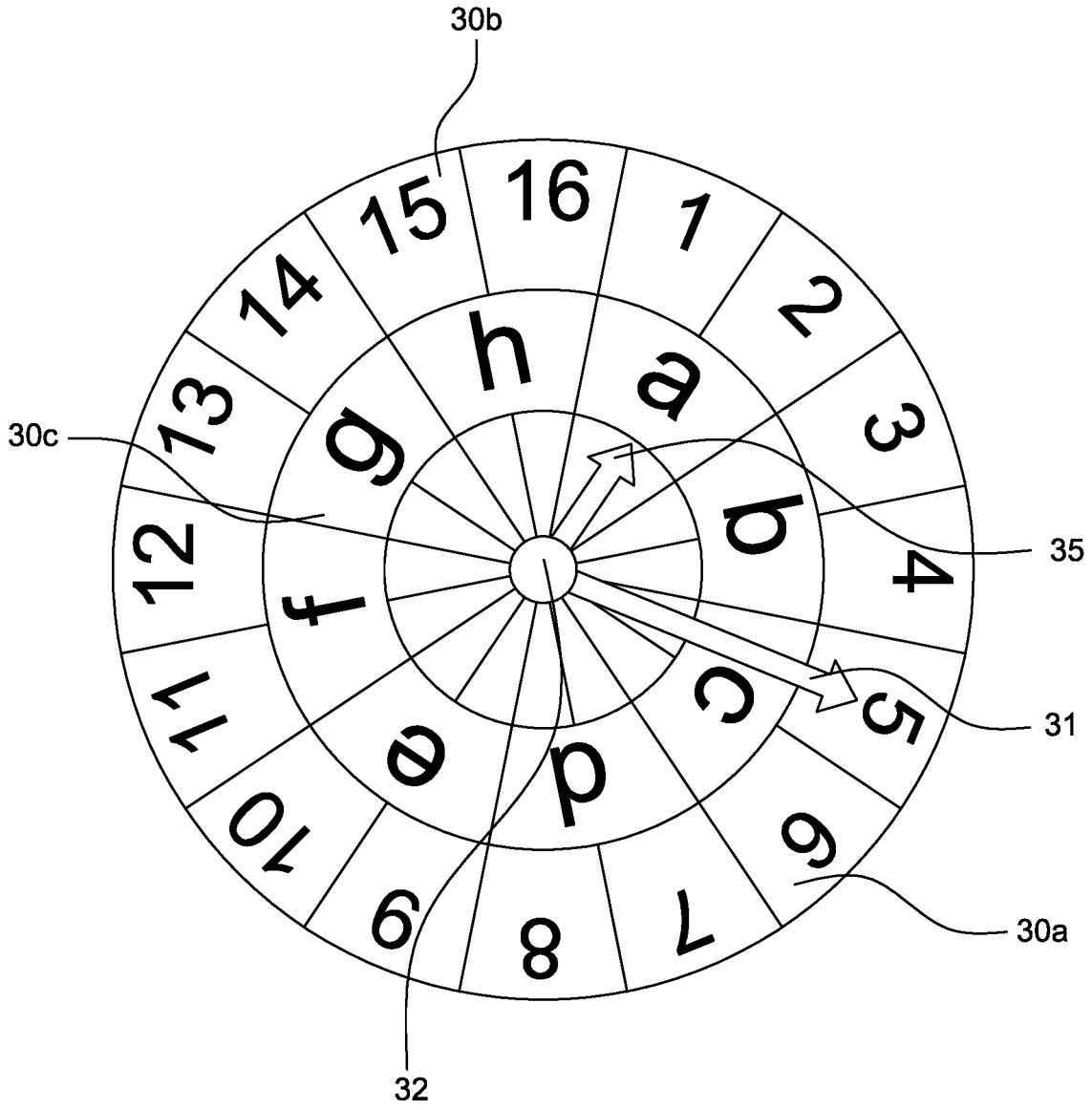
Figure 8:
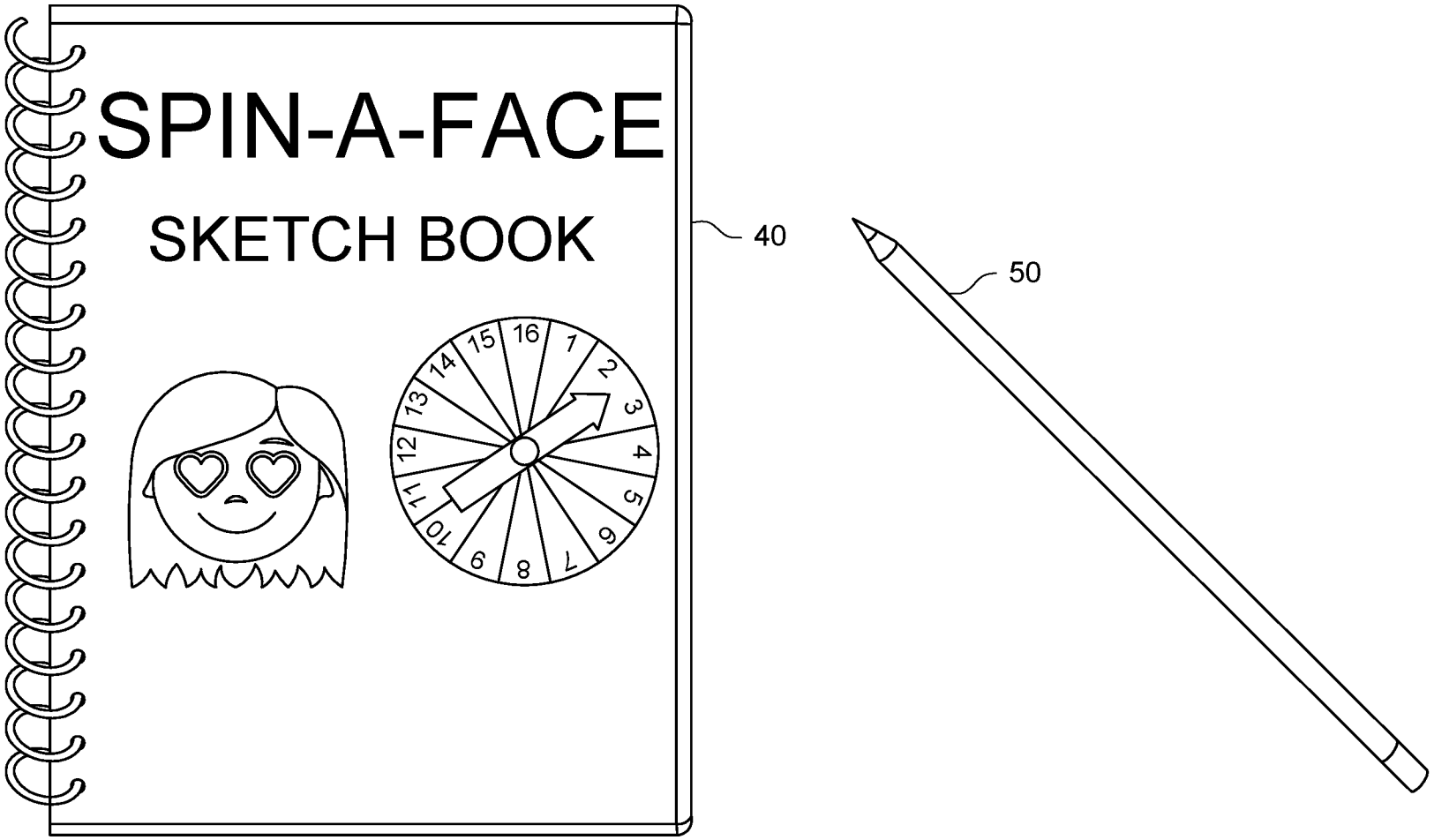

FIG. 6 represents a perspective view of book 20 in open configuration illustrating distinct pictures 25 with unique page identity 24 and identifications 26, in accordance with another embodiment;

FIG. 7 represents a perspective view of a spinning wheel 30 with a first pointer 31 and a second pointer 35, in accordance with another embodiment of the present disclosure; and FIG. 8 represents a perspective view of a sketch pad 40 and a sketching tool 50.

V. DETAILED DESCRIPTION OF THE EMBODIMENTS OF THE INVENTION

Referring now to the drawings, FIGS. 1-8, where the present invention is generally referred to with numeral 10, it can be observed that an interactive activity game 10, in accordance with one embodiment, is provided that mainly includes a plurality of picture pages 21, a spinning wheel 30 and at least one pointer 31.

Plurality of picture pages 21 can be bound in a book 20 having a front cover 22 and a back cover 23. Alternatively, plurality of picture pages 21 can be loose pages, which can be plastic coated for protection from getting torn. In either case, each picture page 21 is provided with a unique page identity 24. In one embodiment, each unique page identity 24 is a page number such as 1, 2, 3, and so on. Numbers can also be roman numbers or can be any other type of symbols or marks that are unique for each page. Each page is defined with a set of distinct pictures 25. Distinct pictures 25 can be illustrated on either one side of the page or both sides of a page, however, the unique page identities 24 will be provided wherever distinct pictures 25 are illustrated on a page, i.e. either one side or both the sides. Each set of distinct pictures 25 relates to a theme, for example, a set of noses or a set of mouths. Thus, in one set of noses, a number of distinct pictures 25 of different types of noses are illustrated.

In one embodiment, each distinct picture 25 is defined with picture identifications 26 as illustrated in FIG. 6. Thus, picture pages 21 are illustrated with various sets of distinct pictures 25 that when combined forms body parts of humans, animals, birds, cartoon characters animated characters and/or objects formed by assembling different parts such as cars or dollhouse. As depicted, a face of a human can be sketched from the illustrated sketches of distinct pictures 25 related to noses, mouths, heads, lips, hairs, ears, eyes and so on. Further, a set of distinct pictures 25 can include accessories like glasses, mustaches, beards, wrinkles, bruises, band-aid, headbands. Alternatively, set of distinct pictures 25 can form variety of objects such as cars, houses, toys, and similar other objects. Distinct pictures 25 are humorous resemblance of real-world objects.

Spinning wheel 30 is a circular wheel and is operable by players to achieve a rotating configuration. Over a period of time, because of friction, spinning wheel 30 achieves a stationary configuration and remains in stationary configuration until players operate spinning wheel 30. Spinning wheel is divided into a plurality of sectors 30*a*. Each sector 30*a* has a top portion 30*b* featured with one unique page identity 24.

Pointer 31 is connected with spinning wheel 30 by pin connection 32. A bearing 34 is provided to permit smooth rotation between pointer 31 and spinning wheel 30. When spinning wheel 30 achieves stationary configuration, pointer 31 points to one top portion 30*b* of sector 30*a* for indicating the unique page identity 24 featured thereon. Players are required to read unique page identity 24 and search for the picture page 21 corresponding to unique page identity 24.

In one embodiment, activity game 10 further includes a sketch pad 40 and at least one sketching tool 50. Sketch pad 40 includes a plurality of blank pages bound by spiral binding 41 on which sketches can be drawn. Blank pages can also be loose sheets or bounded by any other type of binding. Sketching tool 50 can be one or more sketch pencil(s) or can be colored pencils.

In operation, a player initiates as spin of spinning wheel 30 to achieve rotating configuration and waits till spinning wheel 30 achieves a stationary configuration. Once stationary configuration is achieved, the player reads unique page identity 24 corresponding to sector 30*a* on which pointer 31 points. The player is then required to search for the page having unique page identity 24 as pointed by pointer 31. Since the page is provided with a plurality of distinct pictures 25, player is required to select one distinct picture 25 therefrom and sketch the selected distinct picture 25 in sketch pad 40 by using sketching tool 50. The user or player is required to repeat the process until a complete picture is formed. The picture is formed by a combination of individual distinct picture 25 forming a humorous picture. Either one player can play, or two or more players can play by spinning the spinning wheel 30 one by one.

In another embodiment as illustrated in FIGS. 6 and 7, spinning wheel 30 has two layers of markings one below the other. Top layer 30*b* is labeled with unique page identity 24 and below layer 30*c* is labeled with picture identification 26. Picture identification 26 is an identification mark provided on each distinct picture 25 so that user need not select distinct picture 25 on their own. Picture identification 26 can be alphabets (as depicted), numerals, symbols, marks and the like. Spinning wheel 30 can be provided with one pointer which points to a sector and the player can read both unique page identity 24 and picture identification 26 within the sector or spinning wheel 30 can be provided with two pointers, namely a first pointer 31 and a second pointer 35. First pointer 31 points to unique page identity 24 and second pointer 35 points to picture identification 26. Player needs to search for unique page identity 24 and prepare a sketch corresponding to a picture having picture identification 26. The process is repeated until a humorous picture is formed. Players can then show each other their sketch and the best humorous sketch is selected as the winner.

Activity game 10 of the present disclosure involves a number of skill developing activities such as development of fine motor skills by performing activities of handling pages, spinning, holding sketching tool, preparing sketches. Along with the development of fine motor skills, one also develops reading and searching skills. Thus, activity game 10 involves a number of skill developing activities such as eye-hand coordination. Further, the final sketch so prepared forms a humorous picture and hence players spend good quality time along with learning and fun.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An activity game comprising:

a) a plurality of picture pages, each side of a picture page defined with a unique page identity and a plurality of distinct pictures, each of said plurality of distinct pictures of each page defined with picture identifications;

b) a spinning wheel operable by at least one player to achieve a rotating configuration, said spinning wheel divided into a plurality of sectors, each sector featured with said unique page identities and said picture identifications; and c) first and second pointers in connection with said spinning wheel and in stationary configuration of said spinning wheel, said first pointer points to a sector from said plurality of sectors and unique page identity of the sector and said second pointer point another sector from said plurality of sectors and picture identification of the sector.

2. The activity game as claimed in claim 1, wherein said plurality of picture pages are bounded to form a book having a front cover and a back cover.

3. The activity book as claimed in claim 1 further including a sketch pad.

4. The activity book as claimed in claim 3 wherein said sketch pad includes a plurality of blank pages bound by a spiral binding.

5. The activity book as claimed in claim 1 further including at least one sketching tool.

6. The activity book as claimed in claim 5 wherein said at least one sketching tool is a sketch pencil or a colored pencil.

7. The activity book as claimed in claim 1 wherein said spinning wheel has two layers of markings.

8. The activity book as claimed in claim 1 wherein said plurality of picture pages are loose pages which are coated in plastic configured to provide protection from getting torn.

9. The activity book as claimed in claim 1 wherein said first and second pointers are connected with said spinning wheel by a pin connection.

10. The activity book as claimed in claim 9 further including a bearing located between said pin connection and said spinning wheel.

* * * * *